US005634512A

United States Patent [19]

Bombardelli et al.

[11] Patent Number: 5,634,512

[45] Date of Patent: Jun. 3, 1997

[54] METHOD AND APPARATUS FOR CASTING AND THERMAL SURFACE TREATMENT

[75] Inventors: Bruno Bombardelli, Udine; Cristiano Tercelli, Gorizia, both of Italy

[73] Assignee: Danieli & C. Officine Meccaniche SpA, Buttrio, Italy

[21] Appl. No.: 323,252

[22] Filed: Oct. 14, 1994

[30] Foreign Application Priority Data

| | | | |
|---|---|---|---|
| Oct. 29, 1993 | [IT] | Italy | UD93A0216 |
| May 23, 1994 | [IT] | Italy | UD94A0085 |

[51] Int. Cl.[6] ..... B22D 11/124; B22D 11/22

[52] U.S. Cl. ..... 164/455; 164/414; 164/444; 164/477; 164/486

[58] Field of Search ..... 164/455, 476, 164/477, 486, 414, 417, 444; 29/33 C, 527.7

[56] References Cited

U.S. PATENT DOCUMENTS

| | | | |
|---|---|---|---|
| 3,364,977 | 1/1968 | Machida | 164/486 X |
| 3,480,211 | 11/1969 | Vertesi et al. | 164/444 X |
| 3,759,312 | 9/1973 | Mizikar et al. | 164/444 X |
| 5,454,417 | 10/1995 | Rosenstock | 164/414 X |

FOREIGN PATENT DOCUMENTS

| | | | |
|---|---|---|---|
| 0036342 | 9/1981 | European Pat. Off. . | |
| 0241445 | 10/1987 | European Pat. Off. . | |
| 876890 | 5/1953 | Germany . | |
| 9108023 | 9/1991 | Germany . | |
| 55-45581 | 3/1980 | Japan | 164/414 |
| 57-139458 | 8/1982 | Japan | 164/414 |
| 59-174258 | 10/1984 | Japan | 164/455 |
| 60-49850 | 3/1985 | Japan | 164/455 |
| 4-344859 | 12/1992 | Japan | 164/414 |
| 831299 | 5/1981 | U.S.S.R. | 164/455 |

OTHER PUBLICATIONS

Etienne, A. et al. "Augmentation De La Vitesse De Coulée . . . " in *Revue De Métallurgie–CIT*, Dec. 1984, pp. 917–924.

Marchenko, I.K. "Improving Quality of Semi–Continuously Cast Strands as Result of Developing Secondary Cooling System," in *Steel in the USSR*, vol. 10, Mar. 1980, pp. 193–195.

Patent Abstracts of Japan, vo. 12, No. 424 (M–761) Nov. 10, 1988 & JP A 63–160765 (AICHI Steel Works Ltd) 4 Jul. 1988.

(List continued on next page.)

*Primary Examiner*—J. Reed Batten, Jr.

*Attorney, Agent, or Firm*—Antonelli, Terry, Stout & Kraus, LLP

[57] ABSTRACT

Method for thermal surface treatment in line in a continuous casting machine associated with furnaces to heat hot-charge blooms, the method being applied to fine-grain structural steels and being suitable to obviate the precipitation of compounds of aluminum, vanadium, niobium and the like and to eliminate or at least to reduce greatly the surface faults due to tension, the method being carried out in a continuous casting line comprising at least a mould (13), a secondary cooling chamber (14), an extraction and straightening assembly (15) and a shearing assembly (17), the method being applied in cooperation with the extraction and straightening assembly (15) and including an intense, concentrated cooling of the surface of a bloom (19) passing through by applying a cooling fluid under pressure, which is water-based and is sprayed by a plurality of sprayer nozzles (18), the cooling being adapted to the dimensions of the bloom (19) and being such as to produce a surface temperature between about 400° C. and about 900° C. after the natural tempering caused by the hot core of the bloom (19); and a device suitable to carry out the above method and including a plurality of sprayer nozzles (18) arranged about the circumference of the bloom (19) and facing the bloom (19), the sprayer nozzles (18) being fed with a water-based cooling fluid under pressure and which are associated at least with a device (23) which regulates the pressure.

23 Claims, 2 Drawing Sheets

OTHER PUBLICATIONS

Patent Abstracts of Japan vol. 14 No. 110 (M–943) Feb. 28, 1990 & JP 1–313 169 (Kawasaki Steel) Dec. 18, 1989.

Patent Abstracts of Japan vol. 11, No. 221 (M–608) 17 Jul. 1987 & JP A 62–038 748 (Nippon Kokan KK) 19 Feb. 1987.

Patent Abstracts of Japan vol. 9 No. 55 (M–362) 9 Mar. 1985 & JP A 59–189 052 (Mitsubishi Jukogyo KK) 26 Oct. 1984.

METHOD AND APPARATUS FOR CASTING AND THERMAL SURFACE TREATMENT

BACKGROUND OF THE INVENTION

This invention concerns a method for thermal surface treatment in a continuous casting machine and also concerns a device suitable to carry out this method. The method and relative device according to the invention are employed in the metallurgical field and in particular on continuous casting machines to perform continuous controlled cooling of the bloom being fed.

The invention is applied to the treatment of blooms, billets or slabs having a square, round, rectangular or polygonal cross-section and consisting of fine-grain structural steels.

In the description that follows, we shall use only the word "blooms" for descriptive convenience but shall mean thereby that the device is applied also to billets and slabs having any of the above cross-sections.

The invention is applied advantageously, but not only, to the treatment of the following families of steels: steels for structural uses, steels for cold processing, steels for forging, steels for cementation, hardening and tempering steels and surface hardening steels.

Moreover the invention is applied in particular to steels having an appreciable content of aluminum.

Continuous casting plants use the technique of carrying out a quenching operation on moving blooms before the blooms are fed into a furnace with a hot charge.

The quenching operation in continuous casting plants is performed downstream of the shearing assembly consisting, for instance, of a shears or oxygen-cutting torches, depending on the thickness of the bloom; this shearing assembly is installed downstream of the extraction and straightening segment of the plant.

The quenching operation, however, entails a series of drawbacks linked to the fact that the bloom arriving at the quenching station has too low a temperature.

Moreover, in the plants of the state of the art, when the quenching operation is carried out on the sheared bloom, there is a considerable difference of temperature between its two ends, and this difference of temperature results in a lack of structural homogeneity with consequent faults in the bloom and/or problems in the plant downstream.

There is also the method of cooling the blooms in air, which is advantageously a forced draught at a temperature below 600° C., so as to cause conversion of the austenite in their surface layer before charging them into the furnace.

This entails in practice a cooling of the bloom, which reduces a great deal of the energy saving linked to the hot charging process.

The state of the art includes an auxiliary cooling method which employs a device arranged upstream of the extraction and straightening assembly. This method was devised essentially for carrying out thermal soft reduction, namely to reduce the segregation of the carbon on the central axis of the bloom or billet but not to reduce and eliminate the problems of hot shortness, which are characteristic of a hot charge of steels containing aluminum.

Moreover, this method is applied mainly to steels with a high carbon content and with very low percentages of aluminum.

Furthermore, in the method of the state of the art the surface temperature of the billet or bloom at the straightening assembly is about 800° C. This temperature may be too high to compensate the drawing stresses arising from the extraction and straightening, for these stresses entail a possible occurrence of transverse cracks in the skin of the bar.

SUMMARY OF THE INVENTION

Besides, where the steels have a high aluminum content, the auxiliary cooling of the state of the art may be not enough to eliminate the formation of surface faults, for in this case such formation is due not only to the high temperature but also to precipitation of the nitrides.

The present applicants have designed, tested and embodied this invention to overcome the shortcomings of the state of the art and to achieve further advantages.

The purpose of this invention is to provide a method and device which create in the moving bloom an outer fine-grain layer having a structure of great strength and toughness.

According to the invention the thermal treatment is carried out in the casting line immediately downstream of the extraction and straightening assembly and upstream of the shearing assembly.

According to a variant, the thermal treatment is carried out upstream of the extraction and straightening assembly and within the secondary cooling chamber of the continuous casting machine.

According to another variant, in particular where a short secondary cooling chamber is included which does not reach the vicinity of the extraction and straightening assembly, the thermal treatment is carried out outside the secondary cooling chamber of the continuous casting machine and in a position between that chamber and the extraction and straightening assembly.

According to yet another variant, the thermal treatment is carried out either upstream of the extraction and straightening assembly or downstream of the extraction and straightening assembly and upstream of the shearing assembly.

The device according to the invention makes it possible to have, downstream of the shearing assembly, fine-grain blooms with a surface temperature between 400° C. and 900° C. and to eliminate occurrences of hot shortness caused by precipitation of aluminum nitride or vanadium carbonitride or niobium carbonitride.

This enables the downstream heating furnaces to be charged with blooms in a hot charge condition.

The invention therefore makes possible a reduction of the cycle of heating the blooms charged hot into the furnaces, with an evident saving of energy. These blooms can thus be brought quickly to the required temperature on the basis of the type of steel by using a speed of heating which may reach 500° C. per hour.

The invention also reduces the surface faults which are due to tension and which develop during the cooling of the blooms in air.

The need is therefore also eliminated of having to add nitrogen fixation elements such as titanium and vanadium, which are normally added to prevent formation of the above faults due to tension. This elimination is due to the fact that by means of the invention it is possible to obtain an outer layer even some centimeters thick, but normally at least one centimeter thick, and this outer layer is able to retain and absorb in practice any tension.

A further application of the invention provides the so-called "thermal soft reduction" process where at the outlet of the straightening assembly there is a liquid fraction in the core of the bloom, thus reducing the central segregation.

The device according to the invention comprises a compact series of rows of sprayer nozzles, which are installed on the continuous casting machines so as to cool continuously the bloom which passes through the sprayer nozzles.

These sprayer nozzles are arranged about the periphery of the bloom being fed and are aimed at the bloom in such a way that the whole surface of the bloom is lapped by the jets of cooling fluid.

These sprayer nozzles are fed with a cooling fluid under pressure, which is generally water and of which the pressure and rate of flow can be adjusted as desired to suit the type of steel, the dimensions of the cross-section of the bloom and the speed of feed of the bloom.

Moreover, the rate of flow and the pressure at the sprayer nozzles are altered also according to the depth of the outer layer to be quenched.

According to a variant the means to adjust the sprayer nozzles make possible a differentiated adjustment of the pressure and/or rate of flow at the various sprayer nozzles for special processing requirements.

The localised and concentrated cooling on the surface of the bloom causes a surface quenching of the continuously cast bloom at the temperature of departure from the straightening step, whereas the core of the bloom undergoes a much gentler cooling and stays at a substantially constant temperature.

Next, the heat of the core of the bloom causes self-tempering of the quenched outer zone and leads, on the basis of the final temperature, to a sorbitic structure, or a structure of ferrite and carbides, or a fine-grain austenitic structure.

According to a variant of the invention at least one insulated and possibly heated hood is included downstream of the device positioned between the extraction and straightening assembly and the shearing assembly and accelerates the self-tempering of the quenched outer zone, thus assisting the subsequent shearing operations carried out with a shears or oxygen-cutting torches according to the dimensions of the bloom.

The temperature reached by the surface of the bloom during the self-tempering phase can be varied to suit the type of steel and the properties to be achieved.

The device according to the invention includes advantageously temperature measurement means fitted upstream and downstream respectively, which measure the temperature of the bloom entering and leaving the device.

These temperature measurement means associated also with means measuring the speed of feed of the bloom govern advantageously a controlling, programming and governing unit, which regulates the pressure and rate of flow at the sprayer nozzles.

This controlling, programming and governing unit comprises advantageously storage means containing technological data relating to the various types of steels and the working parameters of the device according to the invention.

The storage means associated with the controlling, programming and governing unit contain in particular the data relating to the thickness of the bloom to be cooled and the temperature to which that thickness has to be brought both in the cooling and in the successive tempering step.

The controlling, programming and governing unit is associated advantageously with data input means comprising a keyboard, for instance.

The surface temperature of the bloom entering the device according to the invention depends on the parameters of the continuous casting machine.

According to a variant the device positioned downstream of the extraction and straightening assembly and also the device positioned upstream thereof, at least where the latter device is outside the secondary cooling chamber of the continuous casting machine, include advantageously, both upstream and downstream, a series of compressed-air nozzles which form a wall of air acting as a door for the entry and exit respectively of the bloom into and out from the device.

These walls of air have the task of preventing the departure of water from the device and of minimising the formation of steam released from the device.

The outlet wall of air has the task also of eliminating water which tends to stay on the upper surface of the bloom leaving the device and which would lead to localised and uncontrolled undercooling of the surface of the bloom with a resulting lack of homogeneity in the cooling of the bloom.

According to another variant an aspiration hood is fitted in cooperation with the device according to the invention so as to aspirate and remove the steam generated.

This aspiration hood may be not included where the device is inside the secondary cooling chamber of the continuous casting machine. In fact, in this case the device cooperates with the means that aspirate and contain the steam present in the secondary cooling chamber.

The device enables a method of cooling blooms to be achieved whereby the rate of flow and pressure of the cooling fluid delivered by the sprayer nozzles are regulated according to the properties of the steel, the speed of feed of the bloom and the temperature of the bloom.

This cooling method enables a precise layer cooled to the desired temperature to be obtained, this layer being then tempered according to a determined curve.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1A:
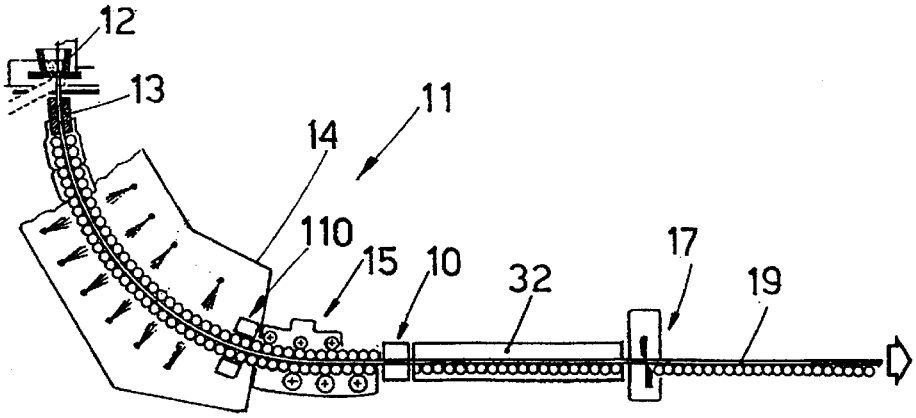
FIG. 1*a* is a diagram of a continuous casting plant in which a device according to the invention is installed.

The reference number 10-110 in the attached figures denotes generally a spray box device according to the invention.

The spray box device 10-110 according to the invention is fitted to a continuous casting line 11 comprising in this case a tundish 12, a mould 13, a secondary cooling chamber 14, an extraction and straightening assembly 15 and a shearing assembly 17.

The spray box device 10 according to the invention as applied to the line of FIG 1*a* has the purpose of cooling continuously a bloom 19 leaving the extraction and straightening assembly 15 so as to carry out a surface quenching of the outer layer of the bloom 19 in a controlled manner.

The spray box device 10 according to the invention is fitted immediately downstream of the extraction and straightening assembly 15 and upstream of the shearing assembly 17.

According to a variant a spray box device 110 is included which is fitted upstream of the extraction and straightening assembly 15 and within the secondary cooling chamber 14 of the continuous casting machine. This spray box device 110 can be fitted as an alternative to, or in combination with, the spray box device 10.

Figure 1B:
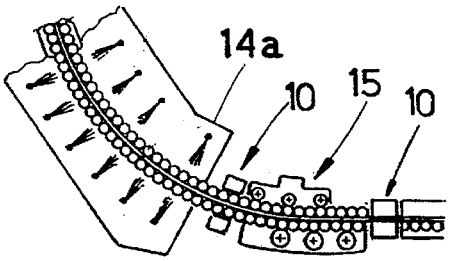
FIG. 1*b* shows partly a variant of the plant of the FIG. 1*a;*

According to the variant of FIG 1*b*, in which a short secondary cooling chamber 14*a* is included which does not reach the vicinity of the extraction and straightening assembly 15, the spray box device 10 is fitted upstream of the extraction and straightening assembly 15 but in a position outside the secondary cooling chamber 14*a*.

The spray box device 10-110 according to the invention comprises a plurality of sprayer nozzles 18 arranged about the periphery of the bloom 19 and aimed at the bloom 19 being fed.

Figure 3A:
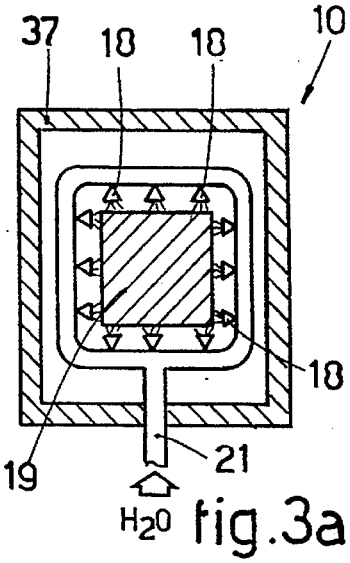
FIG. 3*a* shows diagrammatically a cross-section of the device.
Figure 3B:
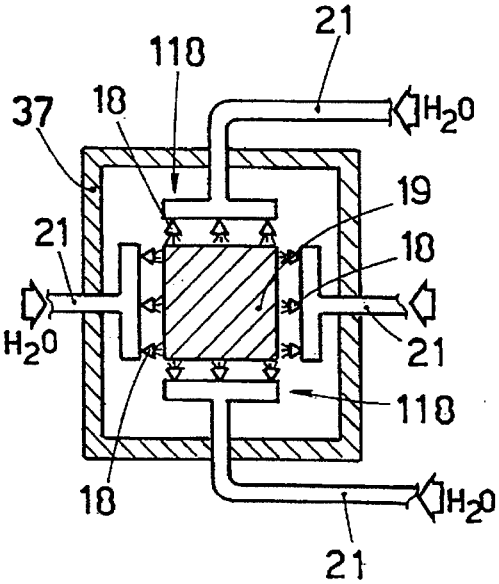
FIG. 3*b* shows a variant of the device of FIG. 3*a;*
Figure 3C:
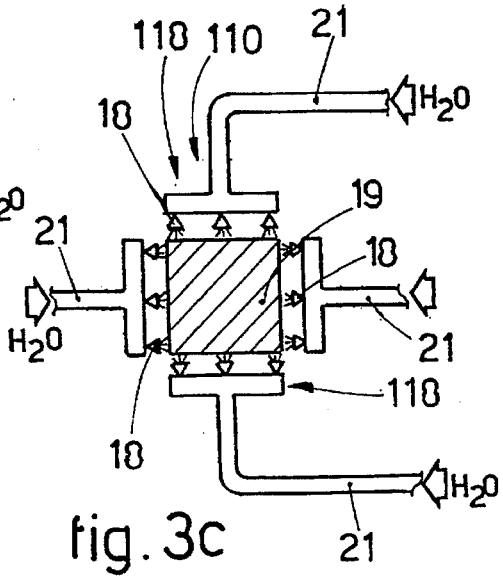
FIG. 3*c* shows diagrammatically a possible cross-section of the device when the latter is within the secondary cooling chamber of the continuous casting machine.
Figure 2:
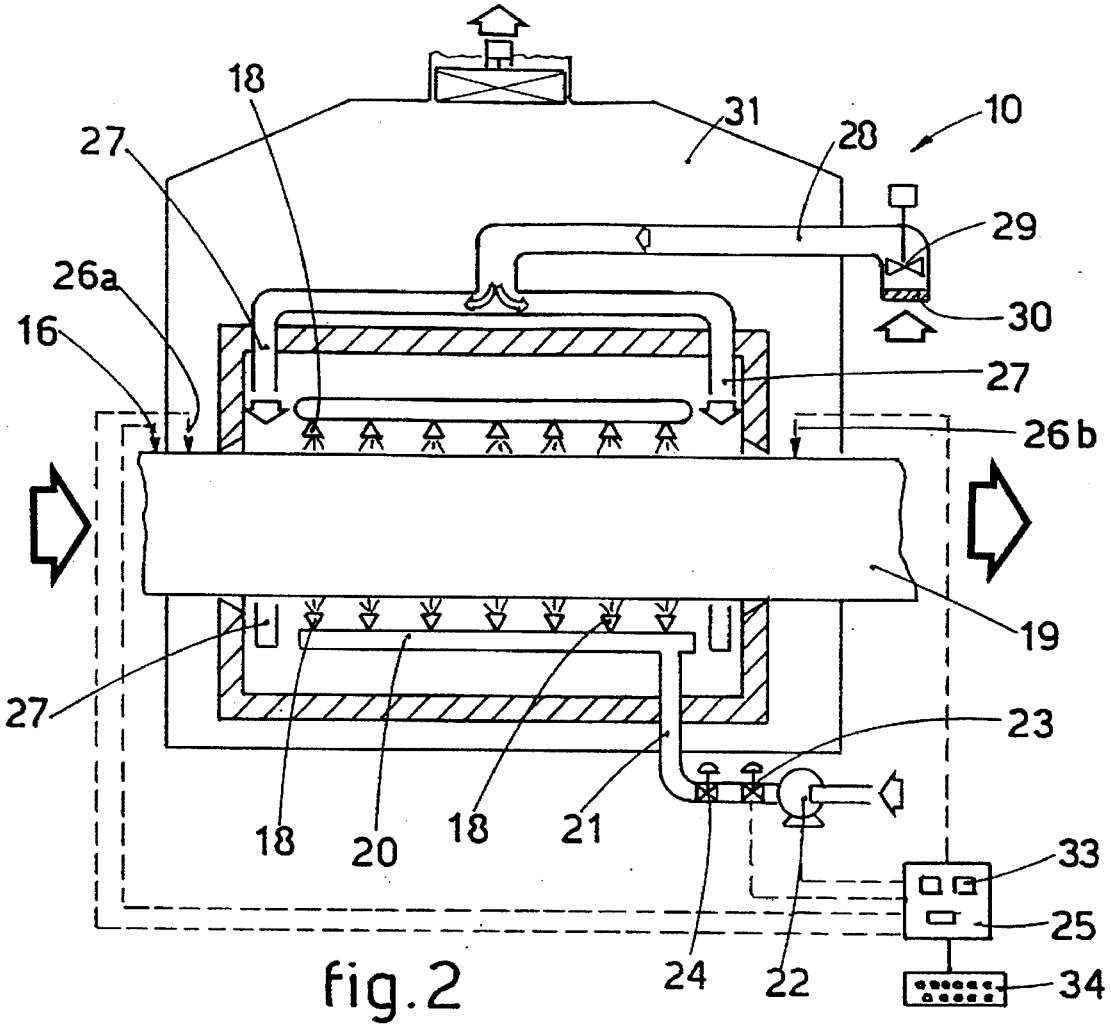
FIG. 2 is a diagram in an enlarged scale of a lengthwise section of the device.

In the case of at least the spray box device 10, the sprayer nozzles 18 are arranged within a containing box structure 37; this containing box structure 37 may be not included in the case of the spray box device 110 (FIG. 3*c*) located within the secondary cooling chamber 14 of the continuous casting machine.

The sprayer nozzles 18 may be arranged in a plurality of rows 20 positioned longitudinally so as to lap a segment of a determined length of the bloom 19.

In this case the sprayer nozzles 18 are associated with a feeder manifold 21, which is connected to means 22 delivering water under pressure.

The feeder manifold 21 includes advantageously means 23 to regulate the water pressure and means 24 to regulate the rate of flow of water so that these two parameters can be altered according to the type of material and the variations of the speed of the bloom 19 being fed with a view to ensuring constant cooling.

According to a variant the pressure regulation means 23 and flow rate regulation means 24 are positioned in such a way that the sprayer nozzles 18 can be fed in a differentiated manner to suit requirements.

According to another variant the sprayer nozzles 18 are divided into groups 118 in a transverse direction and/or lengthwise direction and/or according to the face of the bloom 19 which they are facing; these groups 118 of sprayer nozzles 18 are associated with their own feeder manifold 21 connected to the means 22 delivering water under pressure.

This differentiation of pressure and/or rate of flow of the cooling liquid delivered by the sprayer nozzles 18-118 may be called for, for instance, where it is desired to produce a bloom 19 with characteristics which are not uniform.

The speed of the bloom 19 is measured advantageously by speed measurement means 16 fitted to the continuous casting line 11.

The pressure and rate of flow of the water fed to the sprayer nozzles 18 can be regulated also according to the properties of the steel, the speed of feed of the bloom 19 and the temperature of the bloom 19 so as to obtain at the desired temperature a precise cooled layer which is then tempered according to a determined curve.

Moreover, the pressure and rate of flow of the water fed to the sprayer nozzles 18 can be regulated also according to the type of heating and rolling process which the bloom 19 is to undergo thereafter.

The spray box device 10-110 according to the invention can be associated advantageously with a controlling, programming and governing unit 25 which governs the means 23–24 that regulate the pressure and rate of flow.

According to a variant means 26 to measure the temperature of the bloom 19 are included and are fitted immediately upstream 26*a* and immediately downstream 26*b* respectively of the spray box device 10-110 according to the invention.

The means 26 to measure the temperature of the bloom 19 are associated advantageously with the controlling, programming and governing unit 25 for automatic regulation of the spray box device 10-110 according to the invention.

The controlling, programming and governing unit 25 comprises advantageously storage means 33 containing technological data relating to the various types of steels and the working parameters of the spray box device 10-110 according to the invention.

The controlling, programming and governing unit 25 is associated advantageously with data input means 34 which comprise a keyboard for instance.

The spray box device 10 includes, at its inlet and outlet, means 27 to deliver air under pressure so as to prevent the emerging, from the box structure 37, of steam generated by contact between the cooling water and the bloom 19. These means 27 to deliver air under pressure are arranged to create a wall of air directed substantially at a right angle to the bloom 19 being fed.

This wall of air acts to close the spray box device 10 according to the invention and has the task of reducing the emerging, from the box structure 37, of steam released within the spray box device 10 according to the invention.

The wall of air arranged at the outlet section of the spray box device 10 according to the invention has the further task of removing the water which tends to stay on the surface of the bloom 19 and which could lead to localised and uncontrolled undercooling of the surface of the bloom 19 with the resulting occurrence of a lack of homogeneity of the cooling.

The means 27 to deliver compressed air are fed in this case by a pipe 28 associated with an aspiration means 29 and including at the end of the pipe 28 a filter means 30, which is advantageously of a replaceable type.

In this case an aspiration hood 31 fitted above the spray box device 10 is included to aspirate and discharge steam leaving the spray box device 10.

The aspiration hood 31 may be not included in cooperation with the spray box device 110 positioned inside the secondary cooling chamber 14.

In this case the bloom 19 leaving the spray box device 10 positioned downstream of the extraction and straightening assembly 15 cooperates downstream with an insulated hood 32, which by accelerating the self-tempering of the bloom 19 assists the shearing operations carried out by the shearing assembly 17 positioned downstream.

The insulated hood 32 may include its own heating means consisting, for instance, of burners, which are not shown here.

According to a variant this insulated hood 32 extends beyond the shearing assembly 17.

Figure 4:
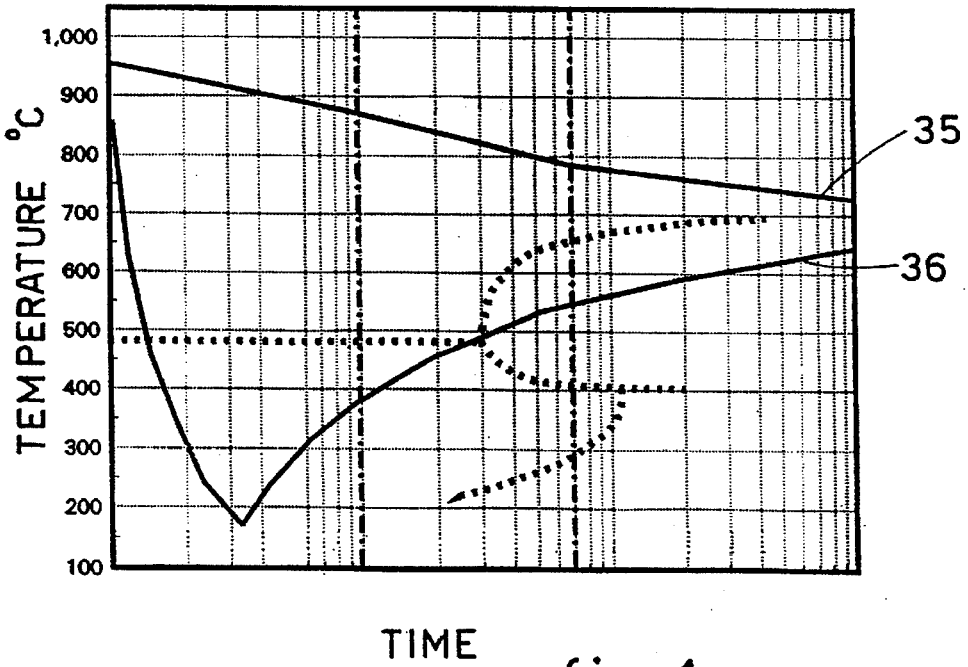
FIG. 4 shows a semi-logarithmic diagram of a possible development of the surface temperature and internal temperature of the bloom as a function of time.

As an example, the semi-logarithmic diagram shown in FIG. 4 represents the momentary development of the temperatures on the surface 36 and in the core 35 respectively of the bloom 19 subjected to the surface quenching treatment in the spray box device 10 according to the invention.

We claim:

1. Method for thermal surface treatment in line in a continuous casting machine associated with a heating furnace to heat hot-charge blooms of fine-grain structural steels and being suitable to obviate the precipitation of compounds of aluminum, vanadium, niobium and to eliminate or at least to reduce greatly the surface faults due to tension, the method comprising continuously casting a bloom in a mould and passing the bloom through a secondary cooling chamber, an extraction and straightening assembly and a shearing assembly, further comprising, before passing the bloom through the shearing assembly, passing the bloom through a plurality of sprayer nozzles thereby effecting an intense, concentrated cooling of the surface of the bloom by means of a water-based cooling fluid under pressure sprayed by the plurality of sprayer nozzles, the cooling being adapted to the dimensions of the bloom and being such as to produce a bloom having a hot core and a surface temperature between about 400° C. and about 900° C. after natural tempering caused by the hot core of the bloom.

2. Method as in claim 1, in which an outer layer affected by the intense, concentrated cooling has a thickness of at least one centimeter.

3. Method as in claim 1, further comprising subsequently heating the bloom in the heating furnace with a speed of heating reaching up to 500° C. per hour.

4. Method as in claim 1, in which the bloom is passed through the plurality of sprayer nozzles immediately upstream of the extraction and straightening assembly.

5. Method as in claim 1, in which the bloom is passed through the plurality of sprayer nozzles within the secondary cooling chamber.

6. Method as in claim 1, in which the bloom is passed through the plurality of sprayer nozzles immediately downstream of the extraction and straightening assembly.

7. Method as in claim 1, further comprising, before the intense, concentrating cooling, lapping the bloom by a current of air under pressure.

8. Method as in claim 1, further comprising, after the intense, concentrated, cooling, lapping the bloom by a current of air under pressure.

9. Method as in claim 1, further comprising, downstream of the intense, concentrated cooling, passing the bloom below an insulated hood.

10. Method as in claim 1, further comprising measuring the speed of the bloom, measuring the temperature of the bloom at an inlet and outlet of the sprayer nozzles, and controlling the intense, concentrated cooling based on the acquired measurements.

11. Method as in claim 10, in which controlling the intense, concentrated cooling is accomplished by regulating a rate of flow of the cooling fluid.

12. Method as in claim 10, in which controlling the intense, concentrated cooling is accomplished by regulating the pressure of the cooling fluid.

13. A continuous casting line includes a spray box device to carry out a method of thermal surface treatment of blooms of fine-grain structural steels to obviate the precipitation of compounds of aluminum, vanadium, niobium and to eliminate or at least to reduce greatly the surface faults due to tension, the spray box device being provided in the continuous casting line comprising at least a mould, a secondary cooling chamber, an extraction and straightening assembly and a shearing assembly, the spray box device being provided upstream of the shearing assembly and comprising a plurality of sprayer nozzles arranged about the circumference of the bloom and facing the bloom, the sprayer nozzles being fed by means for delivering a water-based cooling fluid under pressure and associated at least with means for regulating the pressure to effect an intense, concentrated cooling of the surface of the bloom to produce a bloom having a hot core and a surface temperature between about 400° C. and 900° C. after natural tempering caused by the hot core of the bloom.

14. Continuous casting line as in claim 13, in which the means delivering a cooling fluid are associated with means that regulate the rate of flow.

15. Continuous casting line as in claim 13, further comprising means for measuring the temperature of the bloom fitted at the inlet and outlet respectively of the spray box device, means for measuring the speed of the bloom and a controlling, programming and governing unit associated with the means for measuring the speed of the bloom and the means for measuring the temperature.

16. Continuous casting line as in claim 15, in which the controlling, programming and governing unit includes stored data containing the properties of the various types of steels and the working parameters of the spray box device, the thickness of bloom to be cooled and the temperatures to which that thickness has to be brought in cooling and thereafter in tempering for the purpose of keeping constant the thickness of the cooled layer and the cooling and tempering temperature along the whole bloom.

17. Continuous casting line as in claim 16, in which the controlling, programming and governing unit is associated with data input means.

18. Continuous casting line as in claim 13, further comprising means to deliver compressed air at an inlet and/or an outlet of the spray box device.

19. Continuous casting line as in claim 13, further comprising, immediately downstream of the spray box device, an insulated hood positioned upstream of the shearing assembly.

20. Continuous casting line as in claim 13, wherein the spray box device incudes an aspiration hood.

21. Continuous casting line as in claim 13, wherein the spray box device is provided immediately downstream of the extraction and straightening assembly and upstream of the shearing assembly.

22. Continuous casting line as in claim 13, wherein the spray box device is provided immediately upstream of the extraction and straightening assembly.

23. Continuous casting line as in claim 13, wherein the spray box device is provided within the secondary cooling chamber of the continuous casting machine.

* * * * *